United States Patent [19]

Jacques et al.

[11] Patent Number: 4,808,320

[45] Date of Patent: Feb. 28, 1989

[54] FABRIC SOFTENING COMPOSITIONS BASED ON LECITHIN AND METHODS FOR MAKING AND USING SAME

[75] Inventors: Alain Jacques, Blegny; Patrice Pirotton, Esneux, both of Belgium

[73] Assignee: Colgate-Palmolive Company, New York, N.Y.

[21] Appl. No.: 910,928

[22] Filed: Sep. 24, 1986

Related U.S. Application Data

[63] Continuation-in-part of Ser. No. 896,912, Aug. 14, 1986, abandoned.

[51] Int. Cl.[4] ..... D06M 13/34

[52] U.S. Cl. ..... 252/8.8; 252/8.6

[58] Field of Search ..... 252/8.75, 8.6, 8.7, 252/8.8, 8.9; 514/78

[56] References Cited

U.S. PATENT DOCUMENTS

| | | | |
|---|---|---|---|
| 1,946,332 | 2/1934 | Rewald | 134/18 |
| 2,020,517 | 11/1935 | Rewald | 8/584 |
| 2,069,971 | 2/1937 | Schneider | 28/1 |
| 2,621,133 | 12/1952 | Gaver et al. | 106/210 |
| 3,257,331 | 6/1966 | Jameston | 252/8.6 |
| 4,409,136 | 10/1983 | Cheng | 252/174.25 |
| 4,643,919 | 2/1987 | Fu | 252/8.75 |

FOREIGN PATENT DOCUMENTS

| | | |
|---|---|---|
| 5066503 | 10/1973 | Japan . |
| 5067305 | 6/1975 | Japan . |

OTHER PUBLICATIONS

Schwarz, "Lechithin From Soybean, Its Uses In The Textile Industry", *Rayon Textile Monthly*, May 1940, pp. (63)295–(64)296.

*Primary Examiner*—Paul Lieberman
*Assistant Examiner*—John F. McNally
*Attorney, Agent, or Firm*—M. M. Grill; N. Blumenkopf

[57] ABSTRACT

Stable easily pourable aqueous fabric softening compositions based on water-dispersible lecithin are provided. The softening component comprises from about 1-20% by weight of the composition. Methods for making the composition are also described. Softening performance is comparable to that obtained by using quaternary ammonium compound softeners. The softener compositions are primarily intended for use in the rinse cycle of an automatic washing machine.

3 Claims, No Drawings

FABRIC SOFTENING COMPOSITIONS BASED ON LECITHIN AND METHODS FOR MAKING AND USING SAME

This application is a continuation-in-part of prior pending application Ser. No. 896,912, filed Aug. 14, 1986, now abandoned.

The invention relates to fabric softening compositions adapted to be used in the rinse cycle of an automatic laundry washing machine. More particularly, this invention is concerned with aqueous fabric softening compositions which utilize natural ingredients to impart softness and other desirable attributes to the compositions. Specifically, the invention is based on the use of lecithin as the active softening agent.

Compositions containing quaternary ammonium salts having at least one long chain hydrocarboxyl group such as distearyl dimethyl ammonium chloride or long-chain imidazolinium salts are commonly used to provide fabric softening benefits when employed in a laundry rinse operation; for example, see U.S. Pat. Nos. 3,349,033; 3,644,203; 3,946,115; 3,997,453; 4,073,735; and 4,119,545, among many others.

However, with the recent increasing importance of environmental awareness it has become desirable to reduce the harsh environmental impact of many synthetic chemicals including the cationic fabric softener compounds. To this end the present inventors have expended considerable effort to find a fabric softening agent which is based on "natural" products, namely a compound or composition which is present as such in nature without further chemical reaction to modify the chemical nature of the compound or composition. However, such natural product must necessarily be capable of providing softening performance at least comparable to present day cationic softeners and at reasonable cost.

As a result of their research, it has been found that lecithin, which is widely available in nature in such products as egg yolks, soya beans, blood, milk and others can be formulated into easily pourable, stable, water dispersible compositions containing such concentrations of lecithin as to provide softening performance comparable on an actual as well on a cost basis with dimethyl distearyl (or ditallow) ammonium chloride, the two most frequently used cationic fabric softening agents.

The use of lecithin and lecithin derivatives in the textile industry has been known for at least 5 decades. B. Rewald in U.S. Pat. No. 1,946,332, issued February 6, 1934, and in U.S. Pat. No. 2,020,517, issued Nov. 12, 1935 describes the use of aqueous emulsions of the phosphatides contained in vegetable seeds, especially soya beans, as dressing, sizing or softening oil in textile manufacture. The Schneider patent No. 2,069,971 describes the use of egg oil for the lubrication of textile yarns and filaments. Modified lecithin is mentioned as a lubricant or assistant for sizing agents in U.S. Pat. No. 2,621,133 to K. Gaver. A water-dispersible lecithin having surface active and antistatic properties is the subject matter of U.S. Pat. No. 3,257,331. A general overview is provided by Dr. E. W. K. Schwarz in "Lecithin From Soybean, Its Uses In The Textile Industry" Rayon Textile Monthly, May 1940, pages (63)295-(64)296.

However, so far as the present inventors are aware, it was not known or suggested in the prior art to use lecithin as a softening agent in a composition which could be used by the consumer in automatic laundry washing machines.

The patent invention, therefore, provides a fabric softening composition which is easy to use in an automatic washing machine, especially as a rinse cycle additive, and which is based on "natural" active ingredients, particularly lecithin, as the fabric softening agent.

According to the present invention, it has been discovered that stable, freely pourable—even at low temperatures—, and easily dispersible in aqueous wash baths—including low temperature wash baths,—fabric softening compositions based on lecithin can be prepared by adding heated lecithin to warm water at an alkaline pH and thereafter neutralizing the dispersion.

Pure lecithin is a fatty acid substituted phosphatidylcholine having the general structural formula:

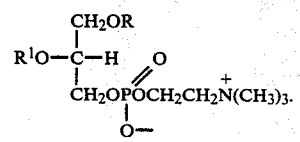

In practice, however, lecithin is rarely available in pure form and generally speaking, lecithin refers to a complex, naturally occurring mixture of phosphatides, triglycerides, carbohydrates, sterols and other minor ingredients.

Lecithin is generally obtained from vegetable oil with soybean oil being the principal source. Other vegetable oil sources of lecithin include corn oil, rapeseed oil, peanut oil, sunflower oil, safflower oil, etc. Other sources of lecithin include egg yolk, milk and animal brains. The phosphatides that are present in lecithin are similar except that their proportions vary. Similarly, the other minor constituents of lecithin vary according to the particular source.

Typical fatty acid profiles of commercially available lecithins are shown in the following table:

Comparative Fatty Acid Profiles (% by weight)

| Number of carbons and double bonds | Soybean Oil | Commercial Lecithin | Oil-Free Commercial Lecithin |
|---|---|---|---|
| saturated | | | |
| $C_{16:0}$ | 9 | 15 | 19 |
| $C_{18:0}$ | 5 | 5 | 5 |
| Total | 14 | 20 | 24 |
| unsaturated | | | |
| $C_{18:1}$ | 26 | 17 | 10 |
| $C_{18:2}$ | 53 | 55 | 59 |
| $C_{18:3}$ | 7 | 8 | 7 |
| Total | 86 | 80 | 76 |

A typical composition of soybean lecithin, the most common commercial product, is as follows:

| | % |
|---|---|
| Phosphatidyl choline (I) | 20 |
| Phosphatidyl ethanolamine (II) | 15 |
| Phosphatidyl inositide (III) | 20 |
| Phosphatic acids and other phosphatides | 5 |
| Carbohydrates, sterols | 5 |

-continued

| | % |
|---|---|
| Triglycerides | 35 |

with

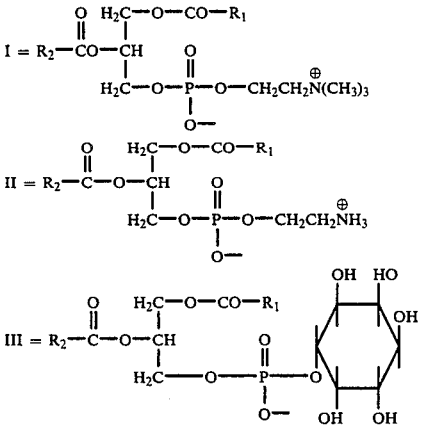

$R_1, R_2 = C_{16:0}, C_{18:0}, C_{18:1}, C_{18:2}, C_{18:3}$.

Any of these naturally occurring forms of lecithin can be used in the present invention. Furthermore, the lecithin need not be pure and any of the commercially available grades of lecithin which are generally mixtures of phosphatidylcholine, phosphatidylethanolamine, phosphatidylinositol (phosphatides) and triglycerides, regardless of the source, e.g. egg yolk, soya beans, etc., can be used as the fabric softening agent in this invention.

Amounts of lecithin ranging from about 1 to about 20% by weight, preferably from about 5 to 18% by weight especially from about 8 to 15% based on the aqueous dispersion can impart fabric softness.

In order to form the stable dispersions the lecithin is heated to about 60° C. (for example from about 45° to 80° C.) and is added with stirring to deionized water (heated to about the same temperature as the lecithin) at an alkaline pH, for example, from about 10 to 13, such as pH 12. Sodium carbonate is preferred as the pH adjusting agent although other basic compounds such as sodium hydroxide, sodium bicarbonate, the corresponding potassium compounds, etc. can be used. Thereafter, the pH of the disperion is brought down to neutral, such as pH 6.5 to 7.5, preferably pH 7. Any acid, but preferably one which is naturally occurring, can be used for this purpose. Good results have been obtained with organic acids such as citric acid, acetic acid and the like. Mineral acids, such as HCl, can also be used.

Thereafter, as desired, other normal types of conventional additives, preferably also natural, can be added to the dispersion. For instance natural essential oils in amounts up to about 2%, preferably 0.1 to 0.8% by weight can be used as perfume. Coloring agents such as chlorophyll can also be used, for example in amounts up to about 2%, preferably 0.5 to 1.5%, by weight.

The aqueous dispersions of lecithin are fully biodegradable, are easily pourable and are dispersible in cold water and when used in the rinse step of a laundry washing operation impart a feeling of softness to the treated fabrics.

The fabric softening compositions of this invention must have in addition to phase stability, the requisite viscosity (i.e. for pourability) and water-dispersibility in the rinse cycle (or any other form of dilution prior to use) which consumers have come to accept and demand. Thus, the products contemplated herein may have viscosities ranging from about 30 cps to about 250 cps and preferably from about 40 cps to about 120 cps.

In use, the fabric softening composition is added to the rinse cycle in an automatic washing machine in an amount sufficient to provide from about 0.36 to about 22 grams lecithin per kilogram of fabric, preferably from about 1 to 15 grams lecithin per kilogram of fabric. Generally, this will correspond to from about 75 to about 150 milliliter of fabric softening composition, preferably about 100 to 120 ml, such as about 110 ml. Of course, the lecithin based softening formulations can also be used in the manual washing and softening of fabric materials, such as clothing, linens, towels and the like.

EXAMPLE

Typical fabric softening compositions according to the invention at different levels of lecithin are prepared by mixing the following ingredients in the order given:

| Ingredient | Amount (parts by weight) |
|---|---|
| Deionized Water (at 60° C.) | 88.5 |
| $Na_2CO_3$ (30% solution) | to pH = 12 |
| Lecithin[1] (at 60° C.) | X |
| Citric Acid (as 1 N solution) | to pH = 7 |
| Perfume (natural essential oil) | 0.5 |
| Chlorophyll (1% solution) | 1.0 |

[1]soy bean lecithin from Vamo Mills Kias

Four different compositions are prepared with the amount (X) of lecithin being varied to provide lecithin concentrations of 6.25 wt %, 10.0 wt %, 12.5 wt % and 15.0 wt %.

The softening ability of each of these compositions according to the invention is evaluated by a panel of experts. Artifically hardened or desized cleaned cotton or terry towels rinsed with the lecithin dispersions at various concentrations, and air dried are used in the evaluations. The tests are carried out in an actual washing machine (Miele W756) on desized cotton terry towels which are washed with a commercial powder detergent at a level of 112.5 grams per 3 kilogram of towels. At each concentration the softening composition is added in an amount of 110 milliliters. Evaluations are made at the end of 1 cycle, 2 or 3 cycles and 6 cycles. Ratings are given on the "Wixon" scale of 1 to 10 with 10 representing the highest softness or on the "Quat Scale", i.e. softness equivalent to Y % of ditallow dimethyl ammonium chloride. For comparison, a commercially available product, Axion 2, is used under the same conditions. The results are shown in the following table:

| Amount | Wixon Scale | | | Quat Scale | | |
|---|---|---|---|---|---|---|
| Lecithin (wt. %) | 1 cycle | 2 cycles | 6 cycles | 1 cycle | 3 cycles | 6 cycles |
| 6.25 | | | | | | |
| 10% | 5 | 6 | 7 | 2 | 2.5 | 2 |
| 12.5% | 8 | 7 | 8 | 3 | 3 | 2 |
| 15% | 6 | 9 | 6 | 2 | 2.5 | 2.5 |
| Axion 2 | 6 | 6 | 6 | 2 | 2.5 | 2.5 |

Unless otherwise noted, all percents and percentages are on a by weight basis.

Thus, it can be seen that the present invention provides an all natural ingredient biodegradable fabric softening composition which is comparable to the commercially available quaternary ammonium salt fabric softener compositions.

What is claimed is:

1. A method for imparting softness to textile fabrics which comprises contacting the fabrics with the composition prepared by adding lecithin at a temperature of from about 45° C. to 80° C. to an alkaline aqueous solution at a temperature of from about 45° C. to about 80° C. and thereafter adding sufficient acid to reduce the pH to from about 6.5 to about 7.5.

2. The method of claim 1 wherein the fabric softening composition is used in the rinsing step of a laundry washing operation.

3. In a method of imparting softness to fabrics during the rinse cycle of an automatic laundry washing machine, the improvement comprising adding the composition of claim 1 in an amount sufficient to provide from about 0.36 to about 22 grams of lecithin per kilogram of fabrics in the washing machine.

* * * * *